US011187478B2

(12) United States Patent
Weinland

(10) Patent No.: US 11,187,478 B2
(45) Date of Patent: Nov. 30, 2021

(54) BARRELED FIREARM, IN PARTICULAR PISTOL, HAVING A RECOIL DAMPER

(71) Applicant: Thomas Weinland, Hamburg (DE)

(72) Inventor: Thomas Weinland, Hamburg (DE)

( * ) Notice: Subject to any disclaimer, the term of this patent is extended or adjusted under 35 U.S.C. 154(b) by 0 days.

(21) Appl. No.: 16/320,330

(22) PCT Filed: Jul. 4, 2017

(86) PCT No.: PCT/EP2017/066603

§ 371 (c)(1),
(2) Date: Jan. 24, 2019

(87) PCT Pub. No.: WO2018/019523

PCT Pub. Date: Feb. 1, 2018

(65) Prior Publication Data

US 2019/0234698 A1 Aug. 1, 2019

(30) Foreign Application Priority Data

Jul. 25, 2016 (DE) ..... 102016009046.4
Jul. 26, 2016 (DE) ..... 102016009185.1

(51) Int. Cl.

| | |
|---|---|
| ***F41A 5/10*** | (2006.01) |
| ***F41A 3/78*** | (2006.01) |
| ***F41A 3/86*** | (2006.01) |
| ***F41A 25/02*** | (2006.01) |

(Continued)

(52) U.S. Cl.

CPC ..... *F41A 5/10* (2013.01); *F41A 3/80* (2013.01); *F41A 3/84* (2013.01); *F41A 3/86* (2013.01);

(Continued)

(58) Field of Classification Search

CPC ..... F41A 3/86; F41A 3/94; F41A 3/80; F41A 3/82; F41A 3/88; F41A 3/78; F41A 5/10

(Continued)

(56) References Cited

U.S. PATENT DOCUMENTS 2,846,829 A 8/1958 Kimball
2,846,926 A 8/1958 Kimball (Continued)

FOREIGN PATENT DOCUMENTS

BE 1009537 5/1997
DE 1040420 10/1958

(Continued)

OTHER PUBLICATIONS

WO2011079359—Firearm Impact-Damping Device (English Translation); https://patentscope.wipo.int/search/en/detail.jsf;jsessionid=146CE69880083DFB5310AD5C6AAFD569.wapp2nA?docId=WO2011079359&tab=PCTDESCRIPTION (Year: NA).*

*Primary Examiner* — Reginald S Tillman, Jr.
(74) *Attorney, Agent, or Firm* — Sand, Sebolt & Wernow Co., LPA

(57) ABSTRACT

A barreled firearm having a mass-locked breechblock and a recoil-damping element which is connected on one side to a frame assembly and on another side to a barrel assembly including a barrel. A housing part of the barrel assembly is mounted in the frame assembly in an axially slidable manner. A support element stationary relative to the barrel is mounted in a breechblock housing or in the frame assembly in an axially slidable manner. Alternatively, a support element stationary relative to the frame assembly is mounted in a breechblock housing in an axially slidable manner. The breechblock housing is guided by the frame assembly in an axially slidable manner and the breechblock housing is supported by the support element by means of a spring element. This design absorbs or reduces recoil when a shot is fired from the barreled firearm.

13 Claims, 3 Drawing Sheets

(51) Int. Cl.

| | |
|---|---|
| ***F41A 3/84*** | (2006.01) |
| ***F41A 5/02*** | (2006.01) |
| ***F41A 5/04*** | (2006.01) |
| ***F41A 3/80*** | (2006.01) |
| ***F41A 25/14*** | (2006.01) |
| ***F41A 25/06*** | (2006.01) |
| ***F41A 3/94*** | (2006.01) |

(52) U.S. Cl.
CPC ..... *F41A 3/94* (2013.01); *F41A 5/02* (2013.01); *F41A 5/04* (2013.01); *F41A 25/02* (2013.01); *F41A 25/06* (2013.01); *F41A 25/14* (2013.01)

(58) Field of Classification Search
USPC ..... 89/183, 198, 199, 196; 42/1.06
See application file for complete search history.

(56) References Cited

U.S. PATENT DOCUMENTS

| | | | | | |
|---|---|---|---|---|---|
| 4,388,855 | A * | 6/1983 | Sokolovsky | F41A 3/92 | 89/196 |
| 5,060,555 | A | 10/1991 | Sater | | |
| 5,127,310 | A * | 7/1992 | Lishness | F41A 3/86 | 42/108 |
| 7,380,487 | B2 * | 6/2008 | Mantras | F41A 3/86 | 42/1.06 |
| 8,286,541 | B2 * | 10/2012 | Lorenzut | F41A 5/12 | 89/190 |
| 2010/0192439 | A1 | 8/2010 | Murello | | |
| 2015/0082978 | A1 | 3/2015 | O'Brien | | |

FOREIGN PATENT DOCUMENTS

| | | |
|---|---|---|
| DE | 1578402 | 4/1970 |
| DE | 69816722 | 4/2004 |
| DE | 602005000575 | 2/2008 |
| DE | 102007003180 | 7/2008 |
| DE | 102009039039 | 3/2011 |
| DE | 102012022682 | 5/2014 |
| EP | 0505917 | 9/1992 |
| EP | 1591742 | 11/2005 |
| FR | 2590012 | 5/1987 |
| WO | 95/16178 | 6/1995 |
| WO | 97/29337 | 8/1997 |
| WO | 2011/079359 | 7/2011 |

* cited by examiner

BARRELED FIREARM, IN PARTICULAR PISTOL, HAVING A RECOIL DAMPER

TECHNICAL FIELD

The present invention relates to a barreled firearm, in particular a handheld firearm, in this case in particular a pistol, having a breechblock system which comprises a breechblock mounted in a slidable manner in a frame assembly.

BACKGROUND

Background Information

In automatic or semiautomatic firearms, the barrel (the gun barrel) is closed at the rear using a breechblock after feed of a cartridge. So-called delayed mass breechblocks are typically applied here, which all fulfill the characteristic that they only open the barrel again when the projectile has already left the barrel or is just about to leave the barrel. After unlocking of the breechblock, it runs back into a breechblock housing, driven by the residual pressure in the barrel or force-controlled by pressurized gas taken from the barrel, wherein a closing spring counteracts the recoil force. The recoil of the breechblock is then stopped by a rear stop in the housing upon reaching the travel distance necessary for an ejection of the shell of the fired cartridge and the feed of a new cartridge to the chamber. During the recoil of the breechblock, the empty cartridge casing is ejected. After the breechblock has been stopped, the closing spring ensures that the breechblock is pushed in the direction of the barrel again. As the breechblock moves forward, it carries along a new cartridge from the magazine in firearms having a magazine and pushes the cartridge into the chamber. The forward movement of the breechblock is stopped by striking of the breechblock on components of the chamber.

Examples of typical such firearms, in the form of handheld firearms here, specifically in the form of handguns designed as pistols, are disclosed in DE 698 16 722 T2, US 2010/0192439 A1, and US 2015/0082978 A1.

One problem, especially in the case of handheld firearms, such as pistols in particular, is the recoil generated upon firing of the shot. It has to be absorbed by the shooter, in the case of long guns by solidly pressing the shoulder stock against the shoulder, in the case of handguns via the arm of the shooting hand, which is typically slightly angled when shooting. The recoil is perceived to be unpleasant by many shooters, especially in the case of handguns. In addition, the recoil frequently results in an evasive movement of the firearm, so that especially when firing multiple targeted shots is required in short succession for example, in the context of a sporting shooting exercise re-aiming at the target and the delivery of a further shot requires more time. Moreover, the expected recoil not infrequently results in an incorrect shooting posture in the shooter, and/or in a counter movement anticipating the recoil, which regularly results in shooting errors.

Providing recoil brakes for the damping absorption of the recoil is known from the field of (generally large-caliber) mounted barreled firearms fixedly installed on weapons platforms, for example, cannons, howitzers, or automatic cannons. Thus, DE 60 2005 00 575 T2 (EP 1 591 742 B2) describes a hydraulic recoil damper, wherein a piston rod of the recoil damper is fastened on a breech ring collar and a damper body is fastened on the fixed support of the firearm.

DE 10 2007 003 180 B4 describes further recoil damping. The recoil damping used here acts between a frame assembly and a barrel assembly and is axially arranged between a breech face region of the barrel assembly and a support region of the frame assembly.

DE 10 2009 039 039 A1 describes a further firearm recoil system. The system described therein consists of a pressure container and a pressure cylinder having pressure piston. The firearm barrel end is connected to the pressure piston cylinder for the compression of a gas cushion in the pressure cylinder. The pressure piston is designed in this case in such a way that a larger cross section for the flowing of the liquid is open during the recoil and a smaller cross section is open as the barrel moves forward.

DE 10 2012 022 682 B8 describes further recoil damping for mass breechblocks. It consists of a breechblock part, in which a braking system is integrated, which is supported by the rear wall of the breechblock part with the aid of a piston rod from the breechblock housing.

Furthermore, DE-OS-1 578 402 discloses a barreled firearm mounted on a support, in which a barrel assembly having breechblock assembly is mounted so it is movable in a damped manner via a recoil damper arranged in a cradle, i.e., a weapons platform, in order to absorb the recoil of the firearm.

SUMMARY

To the knowledge of the inventor, however, there have heretofore not been any handheld firearms, in which a reduction of the recoil is intentionally attempted using a design concept. No attempts or efforts for achieving such a recoil reduction via such measures are known to the inventor either.

The invention is based on the object of damping the recoil momentum occurring due to the firing of a projectile from a barreled firearm, in particular a handheld firearm, especially a pistol in this case, and converting it in particular into a linear movement more pleasant to the shooter. Furthermore, the invention is to ensure a significant improvement in the handling of the occurring acceleration forces and impact forces of the conventional breechblock systems, wherein a good possibility for integration into various types of firearms is to be obtained.

This object is achieved according to the invention by a barreled firearm having the features of a mass-locked breechblock) and a recoil damping element which is connected on one side to a frame assembly and on the other side to a barrel assembly that has a barrel characterized in that a housing part of the barrel assembly is mounted in an axially slidable manner in the frame assembly and either an abutment element fixed in relation to the barrel is mounted in an axially slidable manner in a breechblock housing and/or in the frame assembly, or an abutment element fixed in relation to the frame assembly is mounted in an axially slidable manner in a breechblock housing. The breechblock housing is guided in an axially slidable manner by the frame assembly and the breechblock housing is supported with a spring element by the abutment. A further achievement of this object is a handheld firearm in particular a pistol, having mass-locked breechblock, characterized in that a recoil damping element acts between a frame assembly and a barrel assembly. Other advantageous features of the barreled firearm include that the recoil damper element is a hydraulically acting recoil damper, and a restoring force for restoring the recoil damper is generated by an elastic spring element. The recoil damper element is an elastic polymer damper and is settable with respect to a damping characteristic. A chamber housing is mounted in a slidable manner in the frame assembly, wherein the guide does not occur in parallel to the barrel axis, but rather at an angle which enables the chamber housing to be lowered in relation to the barrel center axis during the recoil, in particular with incorporation of a link guide. The abutment element is a chamber housing. Stop elements arranged respectively on the breechblock housing and on the barrel assembly interact as a stop delimiting the recoil distance of the breechblock in relation to the barrel. The barreled firearm may be a handheld firearm, in particular a handgun, preferably a pistol. The spring element is formed by two or more springs arranged in parallel.

To reduce the recoil forces, the installation of a recoil damper is thus provided in the barreled weapon according to the invention, which can in particular be a handheld firearm, especially a handgun, very particularly preferably a pistol. The momentum which occurs upon firing of a projectile is converted into a more uniform, controlled movement due to the installation of the recoil damper. Furthermore, the movement sequence of the breechblock may thus be positively influenced and occurring movement momentum may be decoupled from the frame assembly.

To also enable an integration of the recoil damper into handheld firearms, in particular those having short barrels or compact dimensions, in one possible embodiment, the inventor proposes a novel configuration of the components moving in the barreled firearm.

According to the invention, a barreled firearm has a locked mass breechblock. In the meaning of the invention, a so-called delayed mass breechblock also falls under the definition of the "locked mass breechblock.

A locked mass breechblock can in particular also be implemented in all possible and conceivable breechblock forms in this case, for example, as a breechblock having Browning locking (so-called Browning breechblock), as a breechblock having rotating barrel locking, as a breechblock having a support flap locking, as a breechblock having wedge locking, as a rolling breechblock, or as a rotary lug breechblock.

A recoil damping element, which can be in particular a hydraulic damper, for example, an oil damper, but also a polymer damper or also a hydraulic brake, is connected using a first side to the frame assembly and using a second side to a barrel assembly, which comprises a barrel of the barreled firearm. In particular, the recoil damper element can be designed as settable with respect to a damping characteristic. The shooter can thus set a damping characteristic pleasant to him, and/or he can adapt the damping characteristic to various types of ammunition fired from the barreled firearm, i.e., various projectile types and/or various loads.

A housing part of the barrel assembly is mounted in an axially slidable manner in the frame assembly, and an abutment part fixed in relation to the barrel, which can be a chamber housing, for example, is mounted in an axially slidable manner in a breechblock housing or in the frame assembly. The breechblock housing is guided in an axially slidable manner by the frame assembly in this case; and the breechblock housing is supported with a spring element on the abutment part.

This configuration enables a particularly compact construction, so that a recoil damping element can be integrated even in a comparatively small installation space in handheld firearms, in particular also in handguns, such as pistols in particular, without severely and disadvantageously changing the characteristics and handling capability of the corresponding handheld firearm.

In particular, the recoil damper element can be a hydraulically acting recoil damper, wherein an elastic spring element is provided, which generates a restoring force for restoring the recoil damper after damping a recoil.

However, it is also possible and provided as an advantageous alternative in the scope of the invention to select an elastic polymer damper as the recoil damper element.

One aspect of the invention is in particular also that a recoil damping element, which acts between a frame assembly and a barrel assembly, is provided in a handheld firearm, in particular a pistol having locked mass breechblock.

With the design according to the invention of barreled firearms, in particular handheld firearms, having a recoil damper element, a recoil can be damped very effectively and thus the shooting using such a firearm can be made more pleasant and more precise shooting can also be enabled.

A further advantage of the invention can also be that due to smoothing of the acceleration momentum, loading errors of the firearm when feeding a new cartridge from the magazine into the chamber as the breechblock moves forward may be avoided, which otherwise occur if a permissible average breechblock velocity is exceeded, frequently triggered by variations in the propellant strength.

A further advantage is also that the firearm weight may be significantly reduced using the recoil damper arrangement according to the invention and embodying the barreled firearm having a mountable barrel especially in the case of handheld firearms having larger calibers.

BRIEF DESCRIPTION OF THE SEVERAL VIEWS OF THE DRAWINGS

Further goals, features, advantages, and possible applications of the barreled firearm according to the invention, in particular a pistol, having a recoil damper element result from the following descriptions of exemplary embodiments on the basis of the drawings. All illustrated features form the subject matter of the invention, as such or in any arbitrary combination, independently of the summary in individual claims or references.

In the figures.

DETAILED DESCRIPTION

Figure 1:
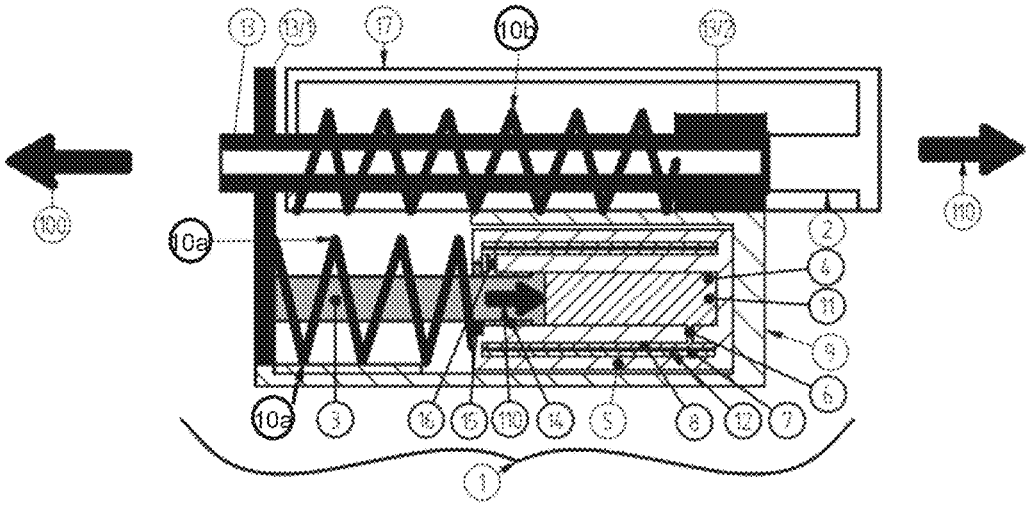
FIG. 1 shows a longitudinal section of a schematically illustrated barreled firearm having an arrangement according to the invention of a recoil damper element in the starting position before shot delivery.
Figure 2:
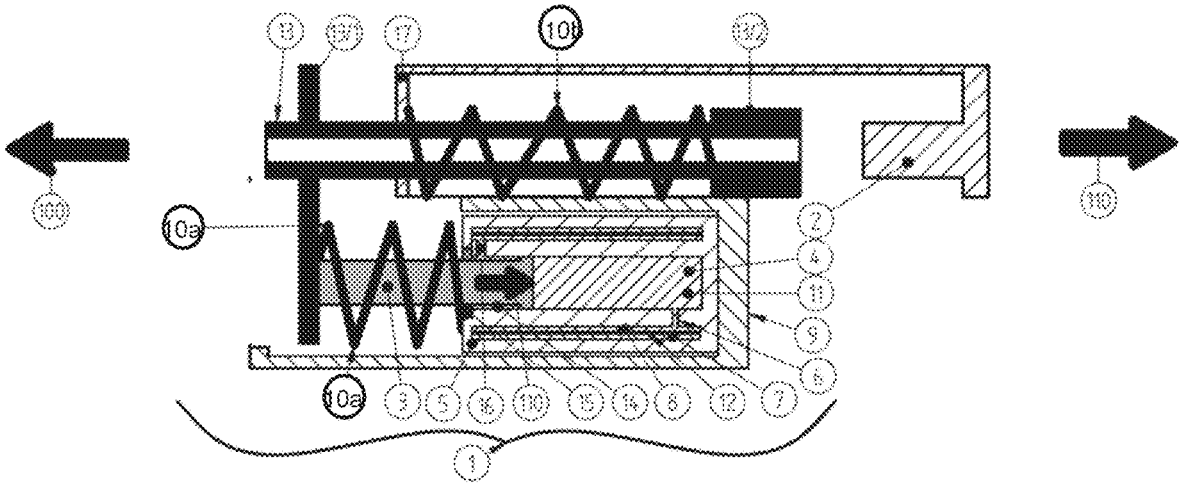
FIG. 2 shows a longitudinal section of a schematically illustrated barreled firearm and the recoil damper element integrated therein according to the invention after shot delivery.

In FIGS. 1 to 2, a detail of a schematically illustrated barreled firearm 1, which can be in particular a handheld firearm, especially a handgun, very particularly a pistol, which is shown in longitudinal section, is identified with 1. The barreled firearm 1 has a barrel 13 and a lockable mass breechblock 2, which is integrated into a breechblock housing 17. The breechblock housing 17 is mounted in a slidable manner in a frame assembly 9 and abuts a chamber (not shown in greater detail) of the barrel 13 on the front side. In this case, an arrow, which indicates the barrel axis and shot direction, is identified with reference sign 100. The side of the barreled firearm identified as located "in front" in this description is located in the direction of this arrow.

The breechblock 2 comprises essentially all components which are necessary for locking with the barrel 13, for firing a cartridge, and for extracting the cartridge after the shot, for ejecting the cartridge and reloading the barreled firearm 1 with a new cartridge. These components are not illustrated in greater detail to simplify the drawing.

A barrel assembly can be seen in FIGS. 1 and 2, which is composed of the barrel 13, a housing part 13/1, and a chamber housing 13/2. The barrel assembly is connected in an axially slidable manner to the frame assembly 9 via the housing part 13/1. The chamber housing 13/2 of the barrel assembly is also guided in an axially slidable manner in the breechblock housing 17 or in the frame assembly 9.

The frame assembly 9 comprises essentially all components such as grip, magazine receptacle, trigger unit, and further components, the illustration of which was omitted in FIGS. 1 and 2 to simplify the drawing.

In FIGS. 1 and 2, an arrow is identified with reference sign 110, which indicates the action direction of the recoil and points in this case in the direction identified here as "back" or "rear".

Upon firing of a cartridge (not shown), the explosion pressure of the propellant acts on the front side of the breechblock 2. This results in an acceleration of the breechblock 2 against the shot direction 100 and a recoil movement is initiated in the direction of the arrow 110. As long as the breechblock 2 is locked with the barrel assembly 13, 13/1, 13/2, the recoil movement is transmitted to the barrel assembly 13, 13/1, 13/2, and this assembly is in turn supported with the housing part 13/1 on a piston rod 3 of a recoil damper. In this case, both the recoil damper having its internal resistance and also an elastic spring element 10*a* counteract the recoil force. During the recoil, the piston rod 3 of the recoil damper is pushed further into a cylinder 4 of the recoil damper, which is arranged in a cylinder housing 5. If the recoil damper is a hydraulic damper, the liquid 11 displaced in this case (in particular an oil) flows via at least one control opening 6 into a liquid collection chamber 8 and via a compensation borehole 16 into a front cylinder chamber 14. A differential volume of the volume in the cylinder 4 and the volume of the front cylinder chamber 14 is temporarily stored in the liquid collection chamber 8, which is separated using a membrane 12 from a compensation chamber 7.

A friction resistance of the flowing liquid 11 (oil) causes a continuous force transmission to the frame assembly 9 to occur over the entire path distance.

During the recoil procedure, the elastic spring element 10*a*, which acts between housing part 13/1 and the recoil damper, is pre-tensioned and after exceeding a recoil apex point, it dissipates the stored energy to the barrel assembly 13, 13/1, 13/2, and thus ensures that the latter is displaced back into the starting position.

In the further course of the recoil procedure, the projectile has left the barrel and the breechblock part 2 is unlocked. From this moment, the barrel assembly 13, 13/1, 13/2 comes to a standstill and only the breechblock housing 17 runs further to the rear, wherein a spring element 10*b*, which acts between breechblock housing 17 and the chamber housing 13/2, is pre-tensioned. A cartridge casing of the fired cartridge is extracted and ejected at the same time. At the end of the recoil path of the breechblock housing 17, both spring elements 10*a*, 10*b* are pre-tensioned using almost equal forces, which causes the barrel assembly 13, 13/1, 13/2 to remain in its rear position after the unlocking from the breechblock part 2.

After the breechblock housing 17 has reached its apex point, the pre-tensioned spring element 10*b* ensures that the breechblock housing 17 is displaced in the shot direction 110. As the breechblock housing 17 moves forward, the breechblock 2 takes a new cartridge out of the housing and inserts it into the chamber. Since the spring element 10*b*, which acts between breechblock housing 17 and chamber housing 13/2 of the barrel assembly 13, 13/1, 13/2, relaxes further during the movement forward, the spring element 10*a* can now also expand, and the barrel assembly 13, 13/1, 13/2 is displaced forward in the direction of the starting position.

During the movement forward, the piston rod 3 travels out of the cylinder 4, wherein the volume in the cylinder 4 enlarges and liquid 11 flows via the control opening 6 from the liquid collection chamber 8, and also liquid 11 flows from the decreasing volume of the front cylinder chamber 14 via the compensation borehole 16 into the cylinder 4.

The time sequence of the recoil can be accelerated in this case by filling the compensation chamber 7 with an unpressurized gas.

After placement of the breechblock 2 on the chamber of the barrel 13, the repetition procedure is completed, and the barreled firearm 1 is ready to fire again.

Figure 3:
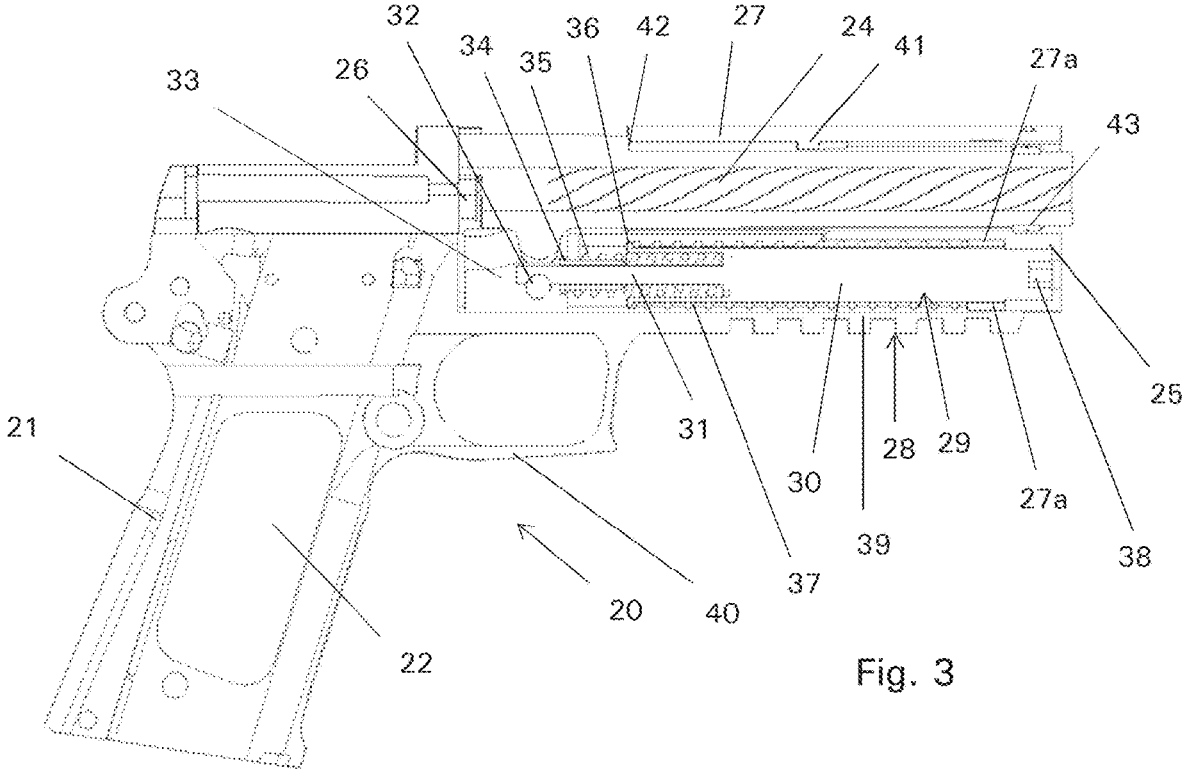
FIG. 3 shows a sectional illustration of a pistol designed in the manner according to the invention in a base position having locked breechblock (before shot delivery)
Figure 4:
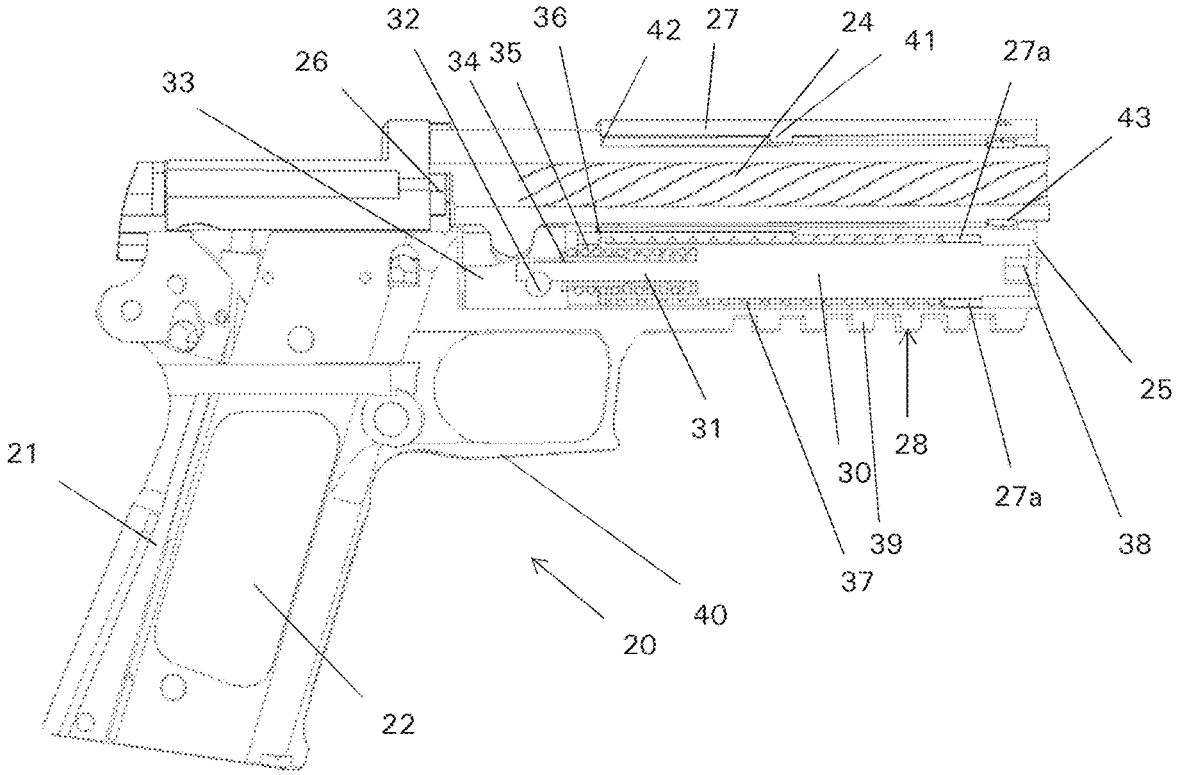
FIG. 4 shows a sectional illustration of the pistol according to FIG. 3 in an intermediate position after firing a shot having combination of breechblock and barrel already moved back by a first distance.
Figure 5:
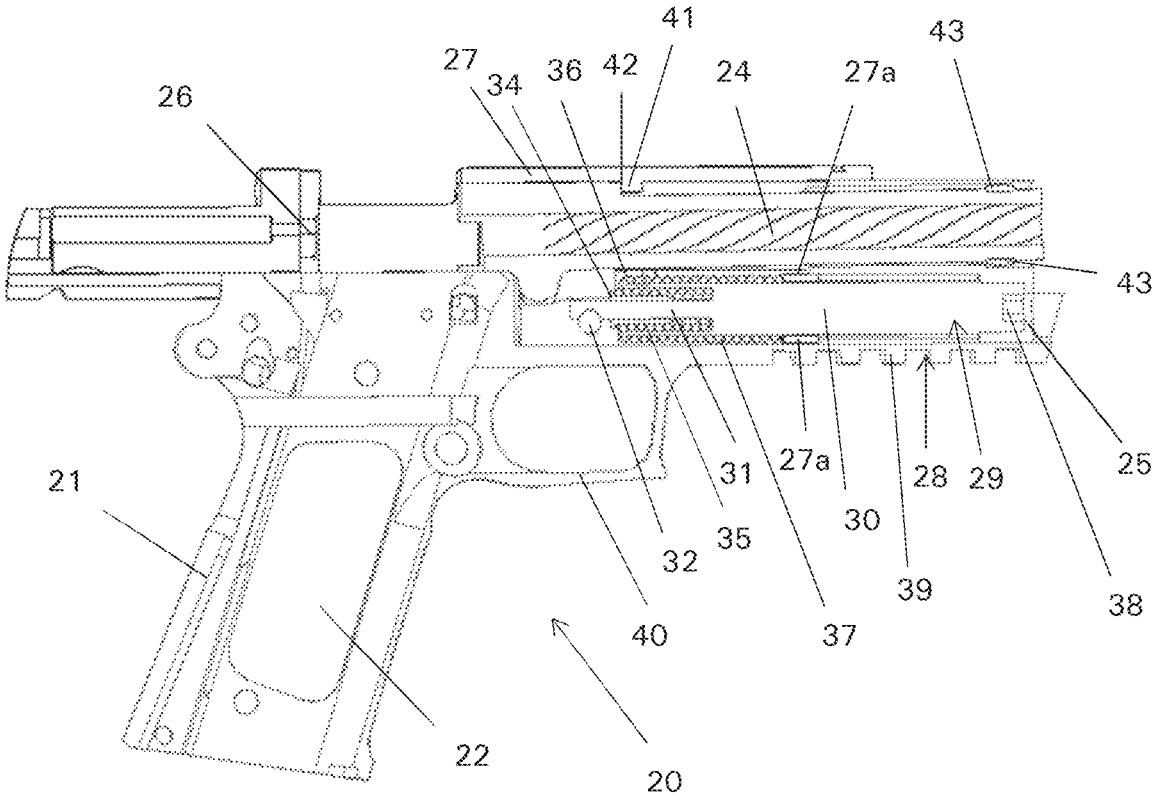
FIG. 5 shows a sectional illustration of the pistol according to FIG. 3 in a position after firing the shot with breechblock moved back completely.

A handheld firearm in the form of a pistol 20 which uses the principle described above on the basis of the general and schematic FIGS. 1 and 2 is illustrated in various sectional illustrations in FIGS. 3 to 5, wherein the arrangement of the two spring elements is solved with a different design here.

The pistol 20, which is shown in each of FIGS. 3 to 5 in a sectional illustration, is formed having essential base elements corresponding to the typical design of such a handgun. In particular, it has a grip 21, in which a magazine shaft 22 is provided, in which a magazine (not shown here) having multiple cartridges, for example, six or eight, can be inserted so that a cartridge located uppermost in the magazine is positioned in a feed position and can be fed in a repetition procedure to a chamber of the firearm. A trigger (not shown here), which is arranged inside a trigger guard 40, is used to trigger the firing pin to fire a shot.

The pistol 20 furthermore has a barrel 24, which is part of a barrel assembly. The barrel assembly also includes, in addition to the barrel 24, a housing part 25 of the barrel assembly, which is located below the barrel 24 in the orientation of the figures and is fixedly connected to the barrel 24 in the axial direction (shot direction). The barrel 24 is mounted so it is pivotable in relation to the housing part 25 via a ball joint 43, to be able to lower the barrel after the shot in accordance with the Browning system. In other types of breechblock, which do not require lowering of the barrel 24, this connection is embodied as rigid as a whole. This housing part 25 already represents an essential special feature and characteristic of the solution and design according to the invention.

A breechblock 26, which closes the rear end of the barrel, more precisely the barrel with the chamber, in a gas-tight manner in the position shown in FIG. 3, has a breechblock housing 27, using which it encloses the barrel 24. In this case, the breechblock housing 27 has an extension 27*a*, which is fixed solidly and rigidly on the breechblock housing 27, in particular is integrally formed thereon, and is a component thereof. This extension 27*a* is also significant for the design according to the invention, as explained in greater detail hereafter.

A frame assembly 28 also contains here, in addition to the grip 21 and the trigger guard 40, a guide section 39. The housing part 25 of the barrel assembly is guided on the one hand in this frame assembly 28, more precisely in the guide section 39, and on the other hand also in the breechblock housing 27. This design measure in particular also effectuates a guide of the barrel assembly and the breechblock 26 in a front region of the pistol 20, so that a higher precision of the firearm can be achieved.

The special feature according to the invention in the pistol 20 shown here is the fact that a recoil damper 29 is arranged therein. The recoil damper 29 contains a cylinder 30 here, in which a piston (not shown in greater detail in the figures) is guided, which is connected to a piston rod 31, which protrudes out of the cylinder 30. The cylinder 30 is rigidly connected in a detachable manner to the housing part 25. The piston rod 31 is secured via a bolt pin 32 connected to a disassembly lever (not shown in greater detail here) in a block part 33, which block part 33 is also a component of the frame assembly 29 and is rigidly connected in the assembled state of the firearm to the further components of the frame assembly 28, and when the bolt pin 32 is disengaged to disassemble the firearm, can be separated from the remaining frame assembly, to also be able to remove the recoil damper. The recoil damper 29 can be in particular a hydraulically acting recoil damper, which is filled, for example, with an oil and operates according to the above-explained principle. The general effect of such recoil dampers or damping elements is known to a person skilled in the art, so that a more extensive explanation is not required here.

A damper restoring spring 35 is guided around the piston rod 31 and is supported with a first end on a collar of a sleeve 34, which is placed on the piston rod 31 and is fixedly connected to the piston rod 31, for example, by a press fit. The damper restoring spring is supported on the cylinder 30 with a second end opposite to the first end. This damper restoring spring 35 thus applies a restoring force, which draws the piston rod 31 and thus the piston (not shown in greater detail here) secured thereon out of the cylinder 30, to the recoil damper 29.

A projection 41 formed on the breechblock housing 27 can also be recognized, which is opposite to a stop edge 42 formed on the barrel. The combination of projection 41 and stop edge 42 causes a stop of the recoil of the breechblock 26 after firing the shot. Moreover, this embodiment of a stop for the breechblock 26 has the result that the momentum occurring as the breechblock 26 runs into the stop is again transferred to the recoil damper 29 and is thus also damped.

A breechblock tensioning spring 37 is supported on one side on the extension 27*a* of the breechblock housing 27 and on the other side on a collar 36, which is formed on the cylinder 30 and is thus fixed in relation to the barrel 24 and the barrel assembly. Finally, a set screw 38 can be seen, which is accessible from the front side of the pistol 20 through an opening in the housing part 25 and via which a damping characteristic of the recoil damper 29 can be set.

The pistol 20 shown in FIGS. 3 to 5 has a breechblock which locks according to the well-known Browning system, which is routine to a person skilled in the art. However, in contrast to the Browning system, in which the barrel is stopped by a stop in its recoil opposite to the shot direction, in the pistol 20 designed according to this exemplary embodiment of the invention, the barrel 24 is in principle movable to the rear freely and without defined stop, is braked by the recoil damper 29 in its reverse movement and is stopped thereby. A maximum reverse displacement of the barrel 24 is theoretically defined by a construction-related stop of the recoil damper 29, wherein the recoil damper 29 in particular is not to be loaded up to its stop during a use of the pistol 20.

The effect and functionality of the pistol 20 according to the invention will be explained hereafter on the basis of the figure sequence of FIGS. 3, 4, and 5. The pistol 20 is shown in a starting position in FIG. 3, in which (not shown here) a cartridge is arranged in the chamber and the barrel is locked with the breechblock 26. The pistol 20 is ready to fire, i.e., a shot can be fired by actuating the trigger.

In this case, the springs damper restoring spring 35 and breechblock tensioning spring 37 are substantially relaxed (possibly provided with a slight pre-tension). If a shot is now fired, the breechblock 26 and with it its breechblock housing 27 and with this assembly firstly also the barrel assembly, i.e., the barrel 24 having the housing part 25, is thus moved, driven by the recoil, to the rear in the direction of the position of the grip 21. This situation is shown in FIG. 4. It can be seen here how both the barrel assembly and also the breechblock 26 are moved in relation to the frame assembly 28 by a travel distance to the rear in the direction of the acting recoil. In this case, the barrel assembly (and also the breechblock housing 27 via the extension 27*a*) is guided by the guide section 39 of the frame assembly 28.

During this movement, the piston located in the cylinder 30 plunges into the cylinder 30, since the cylinder 30 is connected via the housing part 25 to the barrel assembly, the piston rod 31 is connected via the block part 33 to the frame assembly 28, and since these parts move in relation to one another. The damper restoring spring 35 is already compressed and tensioned in this case, as can be seen in FIG. 4. In the situation shown in FIG. 4, the projectile leaves the barrel. During the further backward movement of the breechblock 26, it unlocks due to a guide known per se from the Browning system, according to which the breechblock 26 is conceived in principle here, and travels farther back up to the position shown in FIG. 5, in which the recoil of the breechblock 26 is stopped by the stopping of the projection 41 formed on the breechblock housing 27 using the stop 42 formed on the barrel 24.

During this further recoil, the breechblock tensioning spring 37 is further tensioned by the extension 27*a* of the breechblock housing 27. The piston of the recoil damper 29 is also maximally plunged into the cylinder 30, so that damper restoring spring 35 is also maximally compressed. In the position shown in FIG. 5, the casing of the fired cartridge is ejected, the breechblock 26 has reached its maximum deflection, a apex position. Subsequently, driven by the breechblock tensioning spring 37, which bears on the extension 27*a* of the breechblock housing 27 and is supported thereon, the breechblock 26 is drawn forward, again, wherein it carries along a new cartridge from the magazine in a manner known per se and feeds it to the chamber. At the same time, the damper restoring spring 35 presses the cylinder 30 of the recoil damper 29 forward and thus carries along the barrel assembly via the housing part 25, on which the cylinder 30 is supported at one end and fixed thereon, and thus the barrel 24. The starting position shown in FIG. 3 is reached again at the end of this kinematic procedure.

During the above-described process, damping of the recoil energy in the recoil damper 29 occurs, so that the recoil acting on the shooter after firing the shot is significantly reduced. The pistol 20 according to the invention thus tends substantially less toward an upwardly-oriented breakaway movement, and the firing behavior of this firearm is significantly more pleasant. The shooter can absorb the recoil better and in particular, which is particularly advantageous, for example, for example, during shooting exercises, which require the delivery of multiple precise shots in rapid sequence, can hold the firearm better on the target or bring it back to the target more rapidly and deliver a further targeted shot.

Forming each of the spring-elastic elements for moving forward the breechblock (spring element 10*b* or breechblock tensioning spring 37) and/or for resetting the recoil damper (spring element 10*a* or damper restoring spring 35), respectively, by two or more springs and arranging them differently is also in the scope of the invention. In particular in the case of handguns having short barrels, this can be necessary to obtain a sufficient spring force even with short overall length.

LIST OF REFERENCE SIGNS

1 barreled firearm
2 breechblock
3 piston rod
4 cylinder
5 cylinder housing
6 control opening
7 compensation chamber
8 liquid collection chamber
9 frame assembly
10*a* elastic spring element
10*b* elastic spring element
11 liquid
12 membrane
13 barrel
13/1 housing part
13/2 chamber housing
14 front cylinder chamber
15 seal
16 compensation borehole
17 breechblock housing
20 pistol
21 grip
22 magazine shaft
24 barrel
25 housing part of the barrel assembly
29 breechblock
27 breechblock housing
27*a* extension
28 frame assembly
29 recoil damper
30 cylinder
31 piston rod
32 bolt pin
33 block part
34 sleeve
35 damper restoring spring
36 collar
37 breechblock tensioning spring
38 set screw
39 guide section
40 trigger guard
41 projection
42 stop edge
43 ball joint
100 shot direction
110 recoil direction

The invention claimed is:

1. A barreled firearm comprising:
a mass-locked breechblock;
a recoil damping element which is connected on one side to a frame assembly and on the other side to a barrel assembly, wherein the barrel assembly includes a barrel, and a housing part of the barrel assembly is mounted in an axially slidable manner in the frame assembly; and
an abutment element;
wherein a breechblock housing is guided in an axially slidable manner by the frame assembly;
wherein the breechblock housing is supported with a spring element by the abutment element; and
wherein the abutment element is fixed in relation to the barrel and is mounted in an axially slidable manner in the breechblock housing or in the frame assembly.

2. The barreled firearm as claimed in claim 1, wherein the recoil damping element is a hydraulically acting recoil damper, the spring element is an elastic spring element; and a restoring force for restoring the recoil damper is generated by the elastic spring element.

3. The barreled firearm as claimed in claim 1, wherein the recoil damping element is an elastic polymer damper.

4. The barreled firearm as claimed in claim 1, wherein the recoil damping element is settable with respect to a damping characteristic.

5. The barreled firearm as claimed in claim 1, wherein a chamber housing is mounted in a slidable manner in the frame assembly, wherein the guiding of the breechblock housing does not occur in parallel to a barrel axis, but rather at an angle which enables the chamber housing to be lowered in relation to a barrel center axis during recoil.

6. The barreled firearm as claimed in claim 1, wherein the abutment element is a chamber housing.

7. The barreled firearm as claimed in claim 1, further comprising stop elements arranged respectively on the breechblock housing and on the barrel assembly, wherein the stop elements interact as a stop delimiting a recoil distance of the breechblock in relation to the barrel.

8. The barreled firearm as claimed in claim 1, wherein the barreled firearm is a handheld firearm.

9. The barreled firearm as claimed in claim 1, wherein the spring element is formed by two or more springs arranged in parallel.

10. A hand-held firearm comprising a pistol having a mass-locked breechblock wherein a recoil damping element acts between a frame assembly and a barrel assembly; wherein a first end of the recoil damping element is affixed to the frame assembly and a second end of the recoil damping element is affixed to the barrel assembly in an axially fixed manner with respect to the barrel; and wherein the recoil damping element comprises a hydraulically acting recoil damper.

11. The barreled firearm of claim 5, wherein the guiding of the breechblock housing occurs at the angle which enables the chamber housing to be lowered in relation to the barrel center axis during recoil and with incorporation of a link guide.

12. The barreled firearm as in claim 8, wherein the handheld firearm is a handgun.

13. The barreled firearm as claimed in 12, wherein the handgun is a pistol.

* * * * *